United States Patent [19]

Willy

[11] Patent Number: 4,532,383

[45] Date of Patent: Jul. 30, 1985

[54] ELECTROACOUSTIC TRANSDUCER HAVING A VARIABLE THICKNESS DIAPHRAGM

[76] Inventor: Erazm A. Willy, 128 Country Manor Way, Apartment 7, Webster, N.Y. 14580

[21] Appl. No.: 109,500

[22] Filed: Jan. 4, 1980

[51] Int. Cl.[3] ..... H04R 7/02; H04R 7/12; H04R 9/02; H04R 9/06

[52] U.S. Cl. ..... 179/115.5 R; 179/115.5 DV; 179/115.5 VC; 179/181 R; 181/157; 181/163; 181/165; 181/174

[58] Field of Search ..... 179/115.5 R, 115.5 DV, 179/115.5 H, 115.5 VC, 181 R, 181 F; 181/157, 163, 164, 170, 174

[56] References Cited

U.S. PATENT DOCUMENTS

| | | | |
|---|---|---|---|
| 1,713,006 | 5/1929 | Round | 179/115.5 R |
| 1,999,862 | 4/1935 | Bowles | 181/157 |
| 2,034,882 | 3/1936 | Scribner | 179/115.5 R |
| 2,205,365 | 6/1940 | Schwaen | 179/115.5 DV |
| 2,926,741 | 3/1960 | Rohn et al. | 179/181 F |
| 4,088,847 | 5/1978 | Yukimoto et al. | 179/115.5 VC |
| 4,140,203 | 2/1979 | Niguchi et al. | 181/166 |

FOREIGN PATENT DOCUMENTS

| | | | |
|---|---|---|---|
| 2241445 | 3/1974 | Fed. Rep. of Germany | 179/181 R |
| 864516 | 4/1941 | France | 179/115.5 VC |
| 348425 | 5/1931 | United Kingdom | 179/115.5 VC |

*Primary Examiner*—George G. Stellar
*Attorney, Agent, or Firm*—Antonelli, Terry & Wands

[57] ABSTRACT

To provide for good wide range frequency response utilizing only a single lightweight diaphragm in a peripherally-driven electroacoustic transducer, the diaphragm is made with a variable thickness. The region along the peripheral edge of the diaphragm is the thinnest portion of the diaphragm. From this peripheral edge, the thickness gradually increases to a point of maximum thickness in a portion of the diaphragm other than the periphery. The taper can be such as to provide a diaphragm with either two convex surfaces or with one convex surface and one concave surface. Alternatively, the taper could be linearly. A further embodiment provides for an air-filled diaphragm made of two sheets of thin material with a valve arrangement to allow for rapid self-inflation of the diaphragm.

34 Claims, 7 Drawing Figures

ELECTROACOUSTIC TRANSDUCER HAVING A VARIABLE THICKNESS DIAPHRAGM

FIELD OF THE INVENTION

This invention relates generally to electroacoustic transducers, and more particularly, to a peripherally-driven electroacoustic transducer having a variable thickness diaphragm.

DESCRIPTION OF THE PRIOR ART

In the past, conventional loudspeakers and microphones have utilized a center drive arrangement with an electromagnetic coil located at or near the center of the diaphragm. Although such arrangements have been used for many years, they have a number of drawbacks. For example, such systems are typically rather inefficient in terms of power loss. Also, the high frequency response of such systems tends to be limited due to the sound waves beaming forward in a straight line rather than being provided with a broad dispersion.

To overcome these problems, a peripheral drive electromagnetic transducer was developed by the inventor of the present application and is disclosed in U.S. Pat. No. 3,979,566 which issued on Sept. 7, 1976 and which is incorporated herein by reference. Specifically, as shown in that patent, a peripheral lip of a diaphragm is wound with a coil. This lip with the coil on it is inserted between a pair of pole pieces. With this arrangement, the driving force is applied to the peripheral edges of the diaphragm rather than to the center thereof. As a result, significant improvements in overall efficiency have been attained. Further, when used as a speaker, a wide dispersion is achieved for the propagation of the sound throughout a wide frequency range including high frequencies. The present invention relates to further improvements in these characteristics in the use of a new diaphragm for peripherally-driven electroacoustic transducers.

SUMMARY OF THE INVENTION

Accordingly, it is an object of the present invention to provide a diaphragm having a variable thickness to improve the frequency response in a peripherally-driven electroacoustic transducer.

Another object of the present invention is to improve the efficiency of a peripherally-driven electroacoustic transducer.

A further object of the present invention is to reduce skin effects and the capacitance between windings in peripherally-driven electroacoustic transducers.

Yet another object of the present invention is to reduce the impedance at high frequencies to keep the impedance relatively constant at audio frequencies.

Still another object of the present invention is to provide a self-inflating feature for a variable thickness diaphragm to allow for exceptionally lightweight diaphragms.

With these and other objects in view, the present inventions contemplates a diaphragm for use with peripheral-driven electroacoustic transducers wherein the diaphragm is of variable thickness with its thinnest portion along the peripheral edge thereof. This diaphragm thickness gradually increases to a point of maximum thickness located in a portion of the diaphragm other than at the peripheral edge. The diaphragm can be solid or hollow. Further, the diaphragm can be provided with a self-inflating arrangement.

BRIEF DESCRIPTION OF THE DRAWINGS

Other objects and advantages of the present invention may be more clearly understood by reference to the following detailed description and drawings wherein.

DETAILED DESCRIPTION OF THE INVENTION

Figure 1:
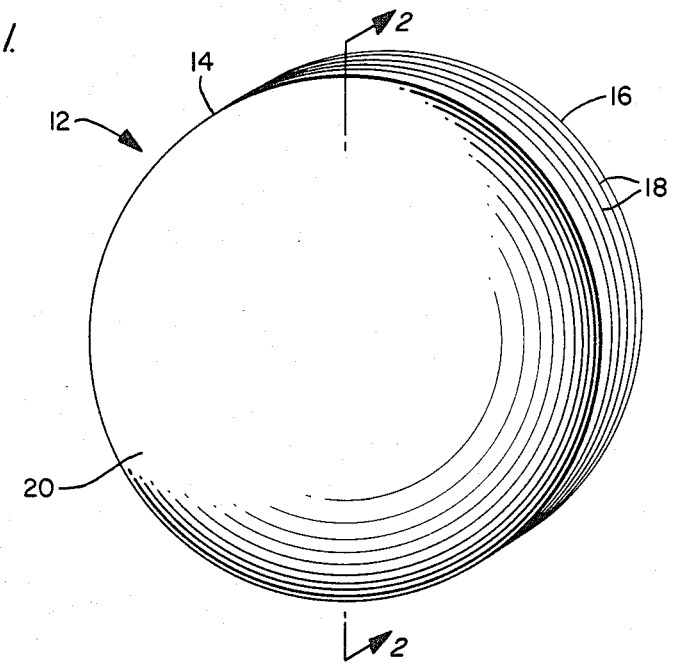
FIG. 1 is a perspective view of the diaphragm and coil windings in an electroacoustic transducer according to the present invention.
Figure 2:
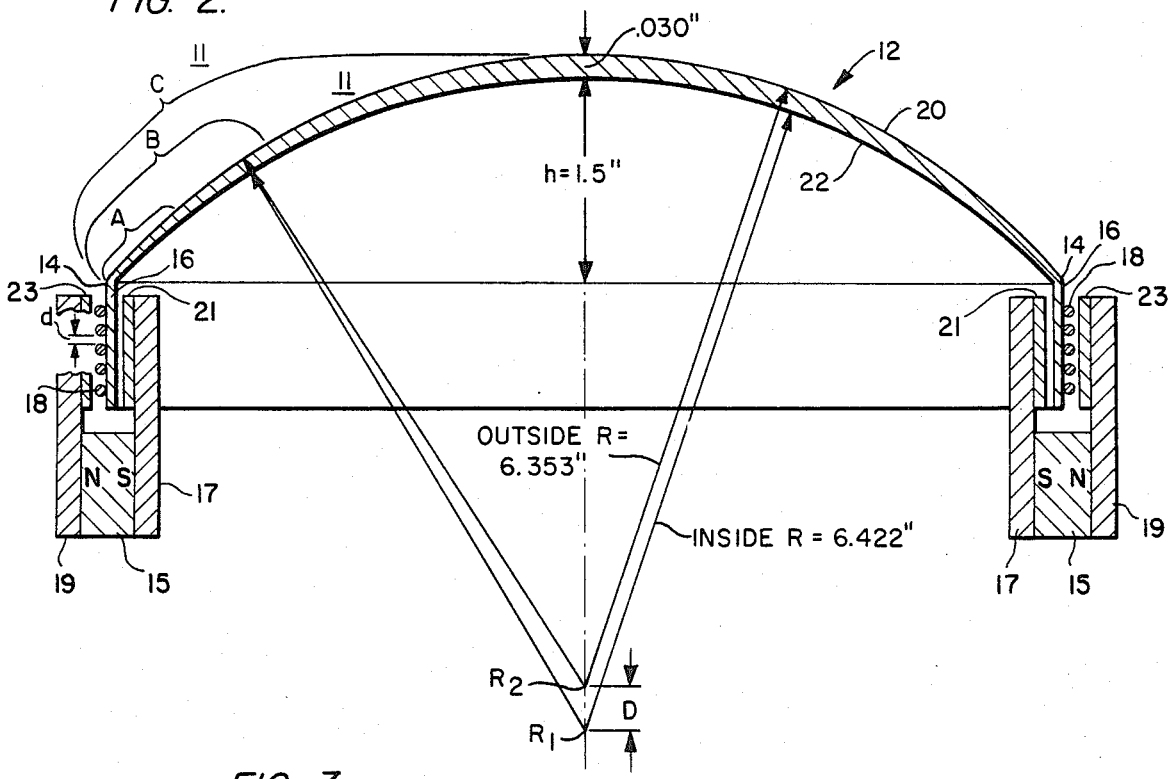
FIG. 2 is a cross-sectional view of FIG. 1 taken along section lines 2—2 of FIG. 1.

Referring now to the drawings, and particularly to FIGS. 1 and 2, a diaphragm 12 is shown for use in an electroacoustic transducer such as a speaker or a microphone. This diaphragm 12 is shown having a variable thickness in FIG. 2 with a thick portion approximately in the center and the thickness gradually tapering off to the thinnest portion at the peripheral edges 14. A lip 16 is provided around the periphery of the diaphragm 12, and an electrical coil 18 is wound around this lip 16. As can be seen in FIG. 2, the outer surface 20 is convex while the inner surface 22 is concave.

In FIG. 2, the variable thickness of the diaphragm 12 allows the establishment of zones for a tweeter A, an intermediate range B and a woofer C. The tweeter is effectively a ring running along the peripheral portion of the diaphragm, while the woofer covers the entire diaphragm area. This allows for one of the significant advantages of the present invention in that the highest frequency signals have the least mass since they are spaced furthest from the thickened center of the diaphragm 12.

In order to reduce capacitance between the windings of the coil 18, another aspect of the present invention involves spacing wires apart by a distance D approximately equal to the diameter of the windings, as shown in FIGS. 1 and 2. In addition, the present invention contemplates the use of Litz wires for such windings. Such Litz wire reduces the skin effect and also significantly improves the high frequency response of the system. In addition, it also helps to reduce the impedance at high frequencies which maintains a constant Z at audio frequencies.

FIG. 2 illustrates one particular method of proportioning the surface for a convex-concave arrangement. Specifically, the convex outer surface of the diaphragm is formed in accordance with a first radius $R_1$ while the inner surface of the diaphragm is formed by a second radius $R_2$ which is longer than $R_1$. The origin points for the radii $R_1$ and $R_2$ lie along a common axis extending through these origins and the center of the diaphragm. A distance D between these origin points equals $R_2-R_1+t$ where t is the desired thickness at the center of the diaphragm. Thus, as shown in FIG. 2, with $R_1=6.353$ inches, $R_2=6.422$ inches, and $D=0.099$ inch, the center width is 0.030 inch. This thickness will gradually taper down to a peripheral edge width of 0.010 inch with the height of the center point of the diaphragm above a line drawn between the arc end points of the periphery being approximately 1.5 inches. Of course, these dimensions are solely for the purpose of example.

The actual particular dimensions of thickness chosen for the diaphragm 12 for use in an electroacoustic transducer such as a speaker or a microphone vary depending on the diameter of the diaphragm and the frequency response desired. For example, if one were to use a speaker with a diaphragm diameter of approximately 10 inches, and desired a frequency range approximately between 30 Hz to 30 KHz, the thickness can be set at the center between an ⅛ and 3/16 inch, tapering out to between 0.003 and 0.005 inch at the edge. Of course, the particular dimensions also depend on the particular characteristics of the material being used. Using spaced Litz wire, as discussed above, having a wire thickness of approximately 0.015 inch and a gap width of between 0.030 and 0.040 for the air gap between the pole pieces into which the diameter lip is inserted, as shwon in U.S. Pat. No. 3,979,566, a maximum flux density in the vicinity of 12,000 gauss is produced. This will produce a speaker diaphragm approximately within the range of 30 Hz to 30 KHz. It is to be noted that the number of turns for the coil winding will depend upon the desired impedance, typically 4 or 8 ohms, and can be determined in a manner well known in the art.

FIG. 2 also shows a cross section of the magnetic structure for the diaphragm using a permanent magnet 15, inner and outer concentric rings 17 and 19, and pole pieces 21 and 23 coupled to the inner and outer concentric rings 17 and 19, respectively. These elements encircle the lip 16 of the diaphragm. It should be noted that a portion of the left-hand illustration in FIG. 2 has been cut away for clarification in the illustration of the winding spacing, but it should be understood that the left-hand illustration corresponds to that of the right-hand illustration of the magnetic structure, and that these illustrations simply represent a cross-sectional view of a ring structure encircling the lip 16. These elements correspond to those shown in the previously-mentioned U.S. Pat. No. 3,979,566, and they operate to concentrate the magnetic flux on the coil 18 in the manner discussed in that U.S. patent.

Figure 3:
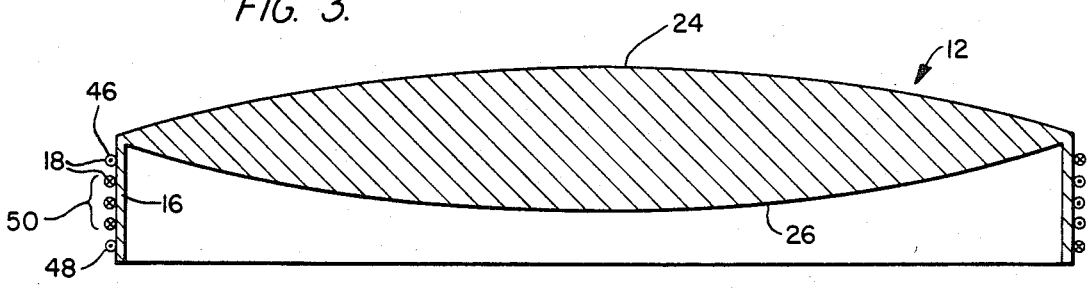
FIG. 3 is a cross-sectional view of an alternative embodiment of the present invention.

The particular shape of the surfaces of the diaphragm is not limited to the convex-concave arrangement shown in FIG. 2. For example, FIG. 3 shows an arrangement with both the outer surface 24 and the inner surface 26 being convex. The outer surface 24 can be formed with a constant radius in the same manner as the outer surface 20 of FIG. 2. The inner surface 26, on the other hand, is made with a constant radius from a point also on the center line of the diaphragm but with the origin point on the other side of the diaphragm.

Figure 4:
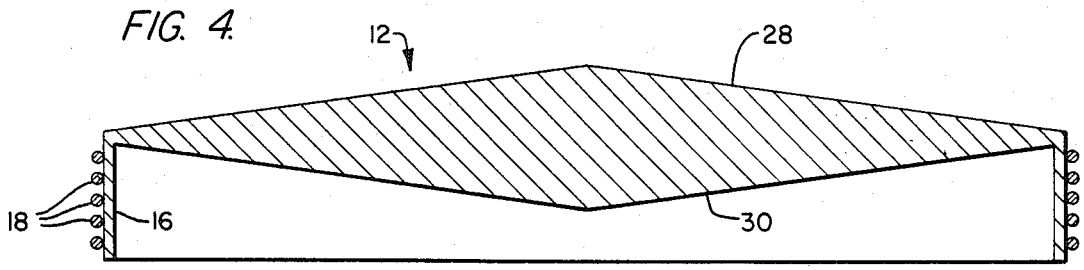
FIG. 4 is a cross-sectional view of another embodiment of the present invention.

Another example of a possible variable thickness diaphragm is shown for the invention in FIG. 4. Here, instead of having a constant radius forming the outer surface 28 and the inner surface 30, a linear taper is provided from the center of the diaphragm to the peripheral edges.

The material chosen for the variable thickness should be one capable of good frequency response while being lightweight, durable, and capable of good reproducibility of diaphragm construction (i.e. with the same basic sound characteristics). Certain plastics have been found to possess these qualities. For example, the polycarbonate plastic manufactured under the trademark Lexan by the General Electric Company is suitable for use in the invention due to its strength and easy workability. However, other plastics with the above characteristics should also be suitable. Also, certain types of flexible, and preferably unbreakable, glass which are commercially available could be used.

A variety of methods are available for working with such plastic or glass to form a diaphragm such as disclosed in the present invention. For example, injection molding and vacuum molding would basically be quite satisfactory for these purposes. However, spin molding and compression molding could also be used. Further, other machine techniques could, of course, be applied where suitable.

Figure 5:
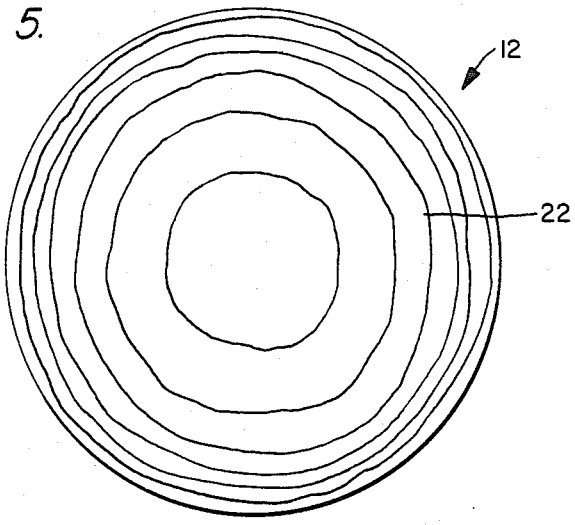
FIG. 5 is a front view of an embodiment of the present invention utilizing a wooden diaphragm.

One alternative to using plastic or glass would be the use of wood, as shown by the front view in FIG. 5. As can be seen in FIG. 5, a diaphragm 12 is formed with a thin wooden sheet 32. However, to obtain proper frequency response with such wood, it has been found best to cut across the grain so that the rings of the wood will form approximately concentric circles around the center thereof. To accomplish the desired frequency characteristics, the wood is first boiled to remove the sap in a manner which is well known. Subsequently, fillers such as that sold under the commercial trademark "Plastic Wood" can be added.

Although the above discussion relates to the use of plastic, glass, and wood, it is of course understood that other material could be used if desired.

Figure 6:
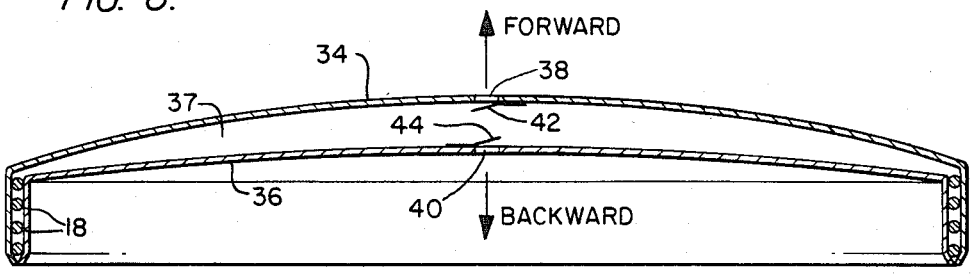
FIG. 6 is a cross-sectional view of another embodiment of the present invention including a self-inflating feature.

Another embodiment of the present invention is shown in FIG. 6. Specifically, in FIG. 6, rather than forming the diaphragm as a solid piece such as shown in FIGS. 1 through 5, an outer sheet 34 and an inner sheet 36 are provided with an air space 37 therebetween. Each of these sheets 34 and 36 includes an opening 38 and 40, respectively, with valve covers 42 and 44 covering these openings respectively. As shown in FIG. 6, the valve covers 42 and 44 are arranged to open based on the direction of movement of the respective sheets 34 and 36 to which they are attached. Specifically, valve cover 42 opens when the outer sheet 34 moves in a forward direction. This valve 42 will open as long as the air pressure inside the air space 37 is less than the pressure exerted by the forward movement of the sheet 34. On the other hand, the valve cover 44 opens whenever the sheet 36 moves in a backward direction. Of course, this valve 44 will also open only as long as the air pressure inside the air space 37 is less than the pressure exerted by the backward movement of the sheet 36.

Based on the operation of the valve covers 42 and 44, a self-inflating action takes place during vibration of the diaphragm. When the valve cover 42 opens, the air rushing into the air space 37 helps ensure closure of the valve cover 44. Similarly, when the valve cover 44 opens, the air rushing in there helps to close the valve cover 42. Thus, air only enters during movement in either direction once the air pressure inside the space 37 is sufficient to hold the valve covers closed while the diaphragm is inactive. As more air is admitted, the diaphragm will rapidly inflate to a point where the air pressure inside is sufficiently greater than the outside air pressure to hold the valve covers closed even during movement of the diaphragm. At typical frequencies used for audio entertainment equipment, the diaphragm would rapidly fill up to this point in less than a second. And, any subsequent loss of air due to leakage will rapidly be compensated for upon movement of the diaphragm.

Preferably, the valve covers 42 and 44 are made as light and small as possible to avoid any undesirable fluttering thereof. And, of course, they must provide a good seal for the opening to prevent any leakage of air during and upon reaching the desired inflation level. It is noted that the use of cellophane valve covers with a thickness of 0.001 inch and a rather small opening of 0.03 inch is one example of a suitable material and appropriate opening sizes for the valve covers.

As in the case of the solid diaphragm shown in FIG. 2, a good material for use in the self-inflating diaphragm for the sheets 34 and 36 is the polycarbonate manufactured as Lexan. These sheets can be provided with a thickness, for example, of approximately 0.005 inch. Such sheets can be rapidly formed by vacuum forming to be assembled with one another. These sheets have sufficient stiffness to remain in a concave-convex arrangement as shown in FIG. 6, if desired. However, one could, of course, also form three into a convex-convex arrangement if desired.

In the arrangement of FIG. 6, rather than winding the coil 18 around the lip 16, the coils can be placed inside the lip inasmuch as such an internal space is formed by the lamination of the sheets 42 and 44 at a point slightly inside of the actual outer periphery. Of course, one can still utilize the benefit of Litz wires and spaced windings, as discussed earlier.

Figure 7:
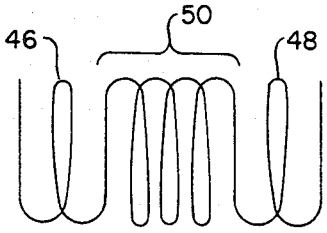
FIG. 7 shows alternative wiring arrangements which can be utilized in the present invention.

An alternative wiring arrangement which can be used in any of the above embodiments, or, for that matter, with a conventional center-driven diaphragm, is shown in FIG. 3. As can be seen from this figure, the outer windings 46 and 48 of the coil winding 18 are in the opposite direction relative to the direction of the center windings 50. This is also shown, for the coil alone, in FIG. 7.

The reason for this opposite direction winding is to counteract an effect which occurs in the reproduction of sound, especially the reproduction of base regions in music, wherein the coil diaphragm often begins to move back and forth along the peripheral lip 16. This can cause the coil-diaphragm assembly to lose motion obedience to the true signal. Further, it can cause undesirable vibrational excursions which can contribute to base distortion. Such vibrations can even lead to rupture of the assembly in extreme cases.

By providing windings in opposite direction at either end of the coil 18, a negative feedback is produced. This negative feedback tends to stabilize the coil to greatly lessen, or even eliminate, the tendency for coil movement along the peripheral lip. As noted above, this is not limited to peripheral drive systems since this phenomenon of coil movement can occur in conventional center-driven diaphragms as well. The use of the reverse end windings will provide stabilization in such conventional diaphragms as well. Further, it should be noted that although only one winding is shown in the reverse direction, a greater number of reversed outer windings could, of course, be used.

Although the diaphragm shown in the figures is round, it is to be understood that a variety of shapes could be used such as, for example, oval, rectangular or square. Also, although FIGS. 1, 3 and 4 are shown as being solid diaphragms, they could have an internal opening if desired, especially in a situation where extreme lightweight is desired.

Of course, it is to be understood that the above specified ranges of thickness, frequency, and size are examples only, and the invention is not limited to only these examples. For example, although it is shown that the thickest portion of the diaphragm is at the center, it is to be understood that this could be at a location other than the center. Also, although the use of Litz wire and spaced windings gives good results, other winding material and arrangements could, of course, be provided.

It is to be understood that the above-identified arrangements are simply illustrative of the application of the principles of this invention. Numerous other arrangements may be readily devised by those skilled in the art which embody the principles of the invention and fall within its spirit and scope.

I claim:

1. A diaphragm for use in a peripheral drive electroacoustic transducer for responding to a range of frequencies from a predetermined low frequency to a predetermined high frequency, said diaphragm having first and second surfaces facing in opposite directions wherein the diaphragm has a variable thickness with the thinnest portion of the diaphragm being along the peripheral edge thereof and the thickness gradually increasing to a point of maximum thickness located in a portion of the diaphragm other than at the peripheral edge thereof, wherein the thicknesses of respective portions of the diaphragm are set so that only a ring portion of the diaphragm adjacent to the peripheral edge thereof will respond to high frequencies in said frequency range while a central portion of said diaphragm within said ring portion remains static at said high frequencies.

2. A diaphragm as in claim 1, wherein the diaphragm is made of wood.

3. A diaphragm as in claim 2, wherein the wood forming said diaphragm is cut so that the tree rings of the wood are concentric on the first and second surfaces of said diaphragm.

4. A diaphragm as in claim 1, wherein the first surface is convex and the second surface is concave.

5. A diaphragm as in claim 1, wherein the first and second surfaces are convex.

6. A diaphragm for use in a peripheral drive electroacoustic transducer for responding to a range of frequencies from a predetermined low frequency to a predetermined high frequency, wherein the improvement comprises said diaphragm having a variable thickness so that it is thinnest along the peripheral edge thereof with the thickness gradually increasing to a point of maximum thickness located in a portion of the diaphragm other than at the peripheral edge thereof, wherein the thicknesses of respective portions of the diaphragm are set so that only a ring portion of the diaphragm adjacent to the peripheral edge thereof will respond to high frequencies in said frequency range while a central portion of said diaphragm within said ring portion remains static at said high frequencies.

7. A diaphragm as in claim 1 or 6, wherein the point of maximum thickness is substantially in the center of the diaphragm.

8. A diaphragm as in claim 1 or 6, wherein the diaphragm is formed as a solid body.

9. A diaphragm as in claim 1 or 6, wherein the thickness of the diaphragm increases linearly between the thinnest portion along the peripheral edge and the point of maximum thickness.

10. A diaphragm as in claim 1 or 6, wherein the first and second surfaces are round.

11. A diaphragm as in claim 1 or 6, wherein the diaphragm has a diameter between 5 inches and 10 inches and the thickness of the diaphragm is between 0.003 inch and 0.005 inch at the thinnest portion along the peripheral edge and between 0.125 inch and 0.2 inch at the point of maximum thickness.

12. A diaphragm as in claim 1 or 6, wherein the diaphragm is made of plastic.

13. A diaphragm as in claim 12, wherein the plastic is a polycarbonate plastic.

14. An electroacoustic transducer comprising:

a diaphragm;

tubular shaped current conduction means comprising a coil with a plurality of windings secured to said diaphragm along a peripheral edge thereof, wherein the plurality of windings includes outer winding sections at each end of the coil and an inner winding section between the outer winding sections, wherein the winding direction of the windings in the outer winding sections is opposite to the winding direction of the windings in the inner winding section to provide a negative feedback electromagnetic field by said outer winding section relative to the electromagnetic field produced by said inner winding section to reduce movement of said current conduction means along the peripheral edge of the diaphragm when current passes through said current conduction means;

concentric tubular shaped open ended magnetic flux translative elements providing at least one tubular shaped air gap therebetween for receiving said current conduction means; and permanent magnet means mounted between said elements for providing concentric magnetic flux from said permanent magnet means through said air gap and said elements.

15. An electroacoustic transducer according to claim 14, wherein said diaphragm has a variable thickness in order to respond to a range of frequencies from a predetermined low frequency to a predetermined high frequency, so that it is thinnest along the peripheral edge thereof with the thickness gradually increasing to a point of maximum thickness located in a portion of the diaphragm other than at the peripheral edge thereof, wherein the thicknesses of respective portions of the dia are set so that only a ring portion of the diaphragm adjacent to the peripheral edge thereof will respond to high frequencies in said frequency range while a central portion of said diaphragm within said ring portion remains static at said high frequencies.

16. A current conducting coil wound on a core which is secured to a diaphragm of an electroacoustic transducer wherein said coil comprises a plurality of windings including outer winding sections at each end of the coil and an inner winding section between the outer winding sections, wherein the winding direction of the windings in the outer winding sections is opposite to the winding direction of the windings in the inner winding section to provide a negative feedback electromagnetic field by said outer winding section relative to the electromagnetic field produced by said inner winding section to reduce movement of said current conduction means along the peripheral edge of the diaphragm when current passes through said current conduction means.

17. An electroacoustic transducer comprising:

a diaphragm for responding to a range of frequencies from a predetermined low frequency to a predetermined high frequency having a variable thickness so that it is thinnest along the peripheral edge thereof with the thickness gradually increasing to a point of maximum thickness located in a portion of the diaphragm other than at the peripheral edge thereof;

tubular shaped current conduction means secured to said diaphragm along a peripheral edge thereof;

concentric tubular shaped open ended magnetic flux translative elements providing at least one tubular shaped air gap therebetween for receiving said current conduction means; and permanent magnetic means mounted between said elements for providing concentric magnetic flux from said permanent magnet means through said air gap and said elements, wherein the thickness of respective portions of the diaphragm are set so that only a ring portion of the diaphragm adjacent to the peripheral edge thereof will respond to high frequencies in said frequency range while a central portion of said diaphragm within said ring portion remains static at said high frequencies.

18. An electroacoustic transducer as in claim 17, wherein the tubular shaped current conduction means is a coil formed of Litz wire.

19. An electroacoustic transducer as in claim 17 or 18, wherein the tubular shaped current conduction means is a coil formed with windings spaced apart from one another by a distance D approximately equal to the thickness of the windings, wherein the distance D is set to reduce the capacitance between the windings during operation of the diaphragm.

20. A diaphragm comprising:

first and second sheets joined together substantially at their peripheries to form an air-tight seal along the periphery of the diaphragm so that an outer surface of the first sheet faces in a first direction, an outer surface of the second sheet faces in a second direction, and an internal space is formed between the inner surfaces of the first and second sheets and the air-tight seal along the diaphragm periphery;

a first opening in the first sheet;

a second opening in the second sheet;

first and second cover layers respectively located on the inner surfaces of the first and second layers over the first and second openings so that when the diaphragm body moves in the first direction pressure is exerted on the first cover layer to uncover the first opening and when the diaphragm moves in the second direction pressure is exerted on the second cover layer to uncover the second opening to inflate the diaphragm until the air pressure in the internal space is equal to the air pressure exerted on the cover layers by virtue of movement in the first and second directions respectively.

21. A diaphragm comprising:

first and second sheets joined together substantially at their peripheries to form an air-tight seal along the periphery of the diaphragm with an internal space between inner facing surfaces of the first and second sheets and the air-tight seal along the diaphragm periphery;

a first opening in the first sheet;

a second opening in the second sheet; and first and second cover layers respectively located on the inner surfaces of the first and second layers over the first and second openings to uncover the openings during movement of the diaphragm.

22. A diaphragm as in claim 20 or 21, wherein the thickness of the first and second sheets is approximately 0.005 inch.

23. A diaphragm as in claim 20 or 21, wherein the diameter of the first and second openings is approximately 1/32 inch.

24. A diaphragm as in claim 20 or 21, wherein the first sheet is convex and the second sheet is concave.

25. A diaphragm as in claim 20 or 21, wherein the first and second sheets are convex.

26. A diaphragm as in claim 20 or 21, wherein the first and second sheets are formed of a polycarbonate plastic.

27. A diaphragm as in claim 20 or 21, wherein the cover layers are formed of cellophane.

28. A diaphragm as in claim 27, wherein the thickness of the cover layers is approximately 0.001 inch.

29. A diaphragm as in claim 20 or 21, further comprising current conduction means formed around the peripheral edge of the diaphragm.

30. A diaphragm as in claim 29, wherein the current conduction means is a coil formed of Litz wire.

31. A diaphragm as in claim 29, wherein the current conduction means is a coil formed with windings spaced apart from one another by a distance D approximately equal to the thickness of the windings, wherein the distance D is set to reduce the capacitance between the windings during operation of the diaphragm.

32. A diaphragm as in claim 29, wherein the first and second sheets are joined together substantially at their peripheries in a manner to provide a region between the first and second sheets outside of the internal space formed by an air-tight seal, which region extends around the periphery of the diaphragm, wherein the current conduction means is located in this region between the first and second sheets.

33. An electroacoustic transducer comprising:

a diaphragm;

tubular shaped current conduction means comprising a Litz wire coil secured to said diaphragm along a peripheral edge thereof;

concentric tubular shaped open ended magnetic flux translative elements providing at least one tubular shaped air gap therebetween for receiving said current conduction means; and permanent magnet means mounted between said elements for providing concentric magnetic flux from said permanent magnet means through said air gap and said elements.

34. An electroacoustic transducer comprising:

a diaphragm;

tubular shaped current conduction means comprising a coil with windings spaced apart from one another by a distance D approximately equal to the thickness of the windings secured to said diaphragm along a peripheral edge thereof;

concentric tubular shaped open ended magnetic flux translative elements providing at least one tubular shaped air gap therebetween for receiving said current conduction means; and permanent magnet means mounted between said elements for providing concentric magnetic flux from said permanent magnet means through said air gap and said elements, wherein the distance D is set to reduce the capacitance between the windings during operation of the diaphragm.

* * * * *